US005426872A

United States Patent [19]

Hayes

[11] Patent Number: 5,426,872

[45] Date of Patent: Jun. 27, 1995

[54] SKI BOOT CLOSURE SYSTEM

[75] Inventor: Jaye B. Hayes, Lancaster, Ohio

[73] Assignee: Tetra Sports Corporation, Lancaster, Ohio

[21] Appl. No.: 269,571

[22] Filed: Jul. 1, 1994

Related U.S. Application Data

[63] Continuation of Ser. No. 19,627, Feb. 16, 1993, abandoned.

[51] Int. Cl.[6] ..... A43B 5/04

[52] U.S. Cl. ..... 36/120; 36/117; 36/54

[58] Field of Search ..... 36/117–121, 36/109, 54, 50.5, 113–116, 50.1, 45

[56] References Cited

U.S. PATENT DOCUMENTS

| | | | |
|---|---|---|---|
| 1,615,032 | 1/1927 | Palmquist | 36/117 |
| 3,792,537 | 2/1974 | Plank et al. | 36/120 |
| 4,510,703 | 4/1985 | Eiteljorg | 36/117 |
| 4,638,578 | 1/1987 | Eiteljorg, II | 36/120 |
| 4,879,822 | 11/1989 | Hayes | 36/114 |
| 5,101,582 | 4/1992 | Pozzobon | 36/117 |
| 5,216,826 | 6/1993 | Chaigne et al. | 36/120 |

*Primary Examiner*—Jimmy G. Foster
*Assistant Examiner*—Thomas P. Hilliard
*Attorney, Agent, or Firm*—Lawrence J. Shurupoff

[57] ABSTRACT

The rigidity of a high performance ski boot is increased by forming interlocking connections between a front tongue, a footbed and a rear ankle portion of the boot. Such connections are particularly effective in reducing or eliminating transverse spreading or sideward flaring of the front tongue as a skier leans forwardly against the tongue during aggressive ski maneuvers. By eliminating such transverse flaring and distortion, the foot support and overall performance of the boot is increased.

7 Claims, 2 Drawing Sheets

FIG 9
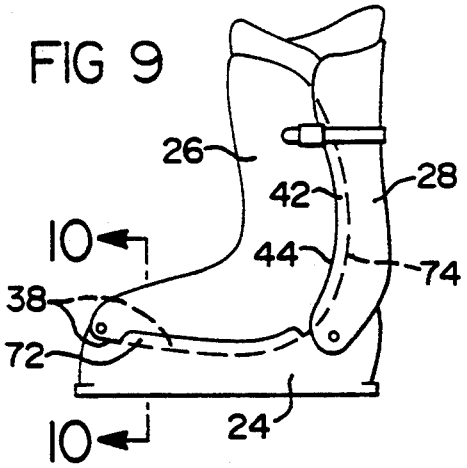
FIG 10
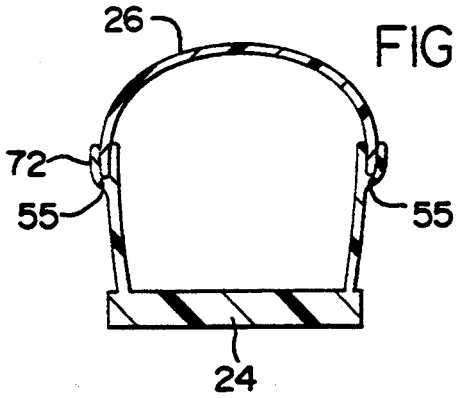
FIG 11
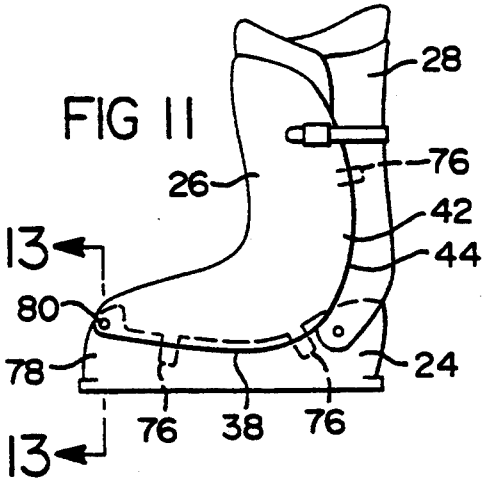
FIG 12
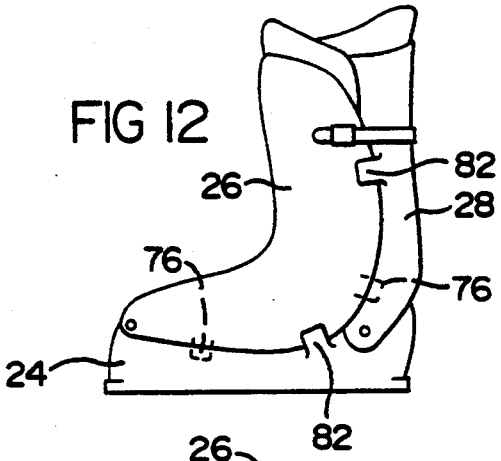
FIG 13
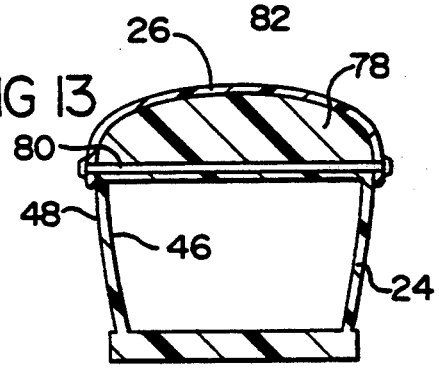
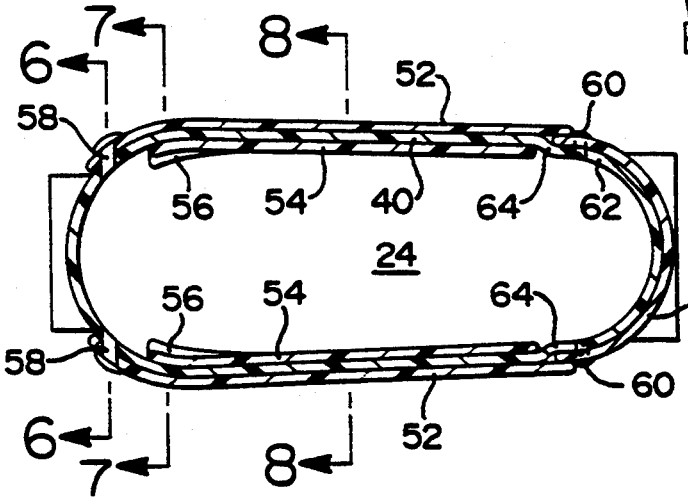
FIG 5

SKI BOOT CLOSURE SYSTEM

This is a continuation of application Ser. No. 08/019,627, filed Feb. 16, 1993, now abandoned.

BACKGROUND OF THE INVENTION

1. Field of the Invention

The present invention relates in general to ski boots and in particular to a rear entry ski boot having mutually reinforcing hinged portions which interfit via tongue and groove type connections.

2. Description of Prior Developments

Rear entry ski boots having front cuffs hinged to front toe portions of the boots are well known in the art and are currently quite popular with skiers seeking high performance, comfort and convenience. An example of such a rear entry toe-hinged boot is disclosed in U.S. Pat. No. 4,879,822, which is incorporated herein by reference. This patent, issued to Hayes, the inventor of the present invention, discloses a ski boot having a footbed to which is pivotally attached a front tongue and cuff member and a rear ankle and cuff member.

Although such prior designs adequately serve their intended purposes, a problem may arise during advanced skiing maneuvers wherein foot support is decreased or lost due to excessive boot flexure. In particular, as a skier leans forward during turning or other forward leaning movements, a significant force may be applied by the skier's instep and lower leg against the front tongue and cuff member of the boot. When this occurs, the typically arched cross section of the tongue and cuff member is deformed and transversely flattened so that its contact and support around the sides of the skier's instep is decreased or lost. Such loss of support is particularly bothersome during advanced skiing maneuvers.

Prior attempts to reduce this loss of support during forward lean have included the use of numerous straps and buckles for binding the tongue and cuff member to the skier's foot and to the footbed and rear ankle and cuff member. This approach is not only inconvenient, as it requires the manipulation of numerous binding straps, buckles and clasps, but it is also prone to form uncomfortable pressure points. These points typically occur between the skier's foot and the front tongue and cuff member directly beneath the bindings.

Accordingly, a need exists for a ski boot which minimizes or prevents the loss of support between the skier's boot and the front tongue and cuff member as a skier leans forward during skiing.

A further need exists for such a ski boot which avoids the use of numerous straps, buckles and clasps so as to prevent the formation of pressure points between the front tongue and cuff member and the region surrounding the front of a skier's ankle and instep.

SUMMARY OF THE INVENTION

The present invention has been designed to fulfill the needs noted above by providing a ski boot with a front tongue and cuff member having increased resistance to transverse deformation during forward lean. Rather than relying on numerous straps and bindings to lash the tongue and cuff member in place and thereby limit transverse deformation, the present invention provides increased structural rigidity to the tongue and cuff member via mutually reinforcing interconnections formed between the tongue and cuff member, the footbed and the rear ankle and cuff member.

By forming the outer edges or peripheral surfaces of the tongue and cuff member, the footbed, and the rear ankle and cuff member with tongue and groove or tabbed interconnections, the moment of inertia and resistance to bending along these interconnections can be significantly increased without resorting to the use of numerous bindings. The phrases "tongue and groove" and "interengagement" as used herein is intended to cover any type of projection or surface which fits within a pocket, recess, hole or channel so as to provide a mutually reinforcing or interlocking connection therebetween.

The location of the tongues and grooves may be varied. In one embodiment, a tongue may be formed along the edges of the rear ankle and cuff member and along the top edges of the footbed for cooperation and engagement within a continuous groove or with a series of tabs or yokes formed along the periphery of the front tongue and cuff member. In another embodiment, the positions of the tongue and grooves or tabs may be reversed.

It is therefore an object of the invention to reinforce the front tongue and cuff portion of a ski boot against deformation and transverse flexure by providing an interengaged connection between the front tongue and cuff member and the footbed as well as between the front tongue and cuff member and the rear ankle and cuff member. Such an interengaged construction not only reduces flexure and deformation of the front tongue and cuff member, but also increases the overall rigidity of the boot. This increased rigidity allows for high performance skiing without loss of support between the boot and the skier's foot.

Another object of the invention is to prevent unsightly distortion of the front tongue and cuff member during forward lean without resorting to the use of numerous bindings, tie downs or straps.

Another object of the invention is to provide a ski boot with a single binding which distributes its closing force uniformly over the front surface of a skier's foot and ankle region.

The realization of these and various other objects, features and attendant advantages of the present invention will be more fully appreciated from the following description when considered in connection with the accompanying drawings, in which the same reference numbers designate the same or corresponding parts throughout.

BRIEF DESCRIPTION OF THE DRAWINGS

The various details of the present invention are described hereinafter with reference to the drawings in which:

FIG. 5 is a view in section taken on line 5—5 of FIG. 2;

FIG. 9 is a side elevation view of an alternate ski boot embodiment constructed in accordance with the invention;

FIG. 10 is a view in section taken on line 10—10 of FIG. 9;

FIG. 11 is a side elevation view of another embodiment of the invention;

FIG. 12 is a side elevation view of yet another embodiment of the invention;

FIG. 13 is a view in section taken on line 13—13 of FIG. 11.

DETAILED DESCRIPTION OF THE PREFERRED EMBODIMENTS

Figure 1:
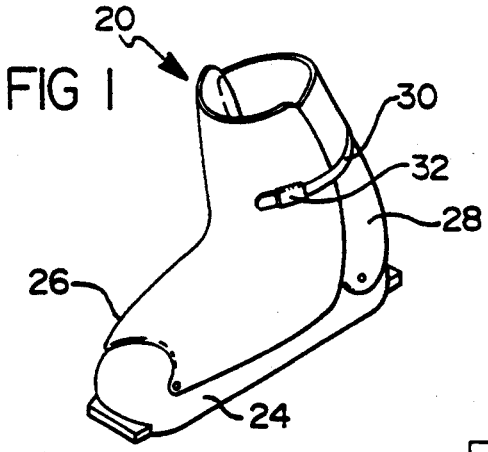
FIG. 1 is a perspective view of a ski boot constructed in accordance with the invention, with cuff and ankle pads removed for clarity.
Figure 2:
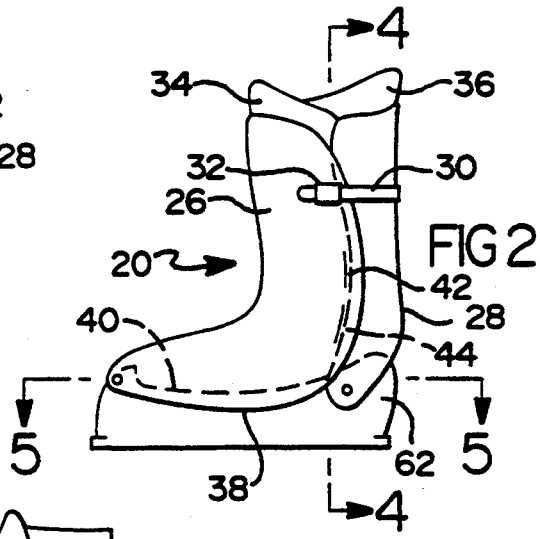
FIG. 2 is a side elevation view of FIG. 1, with cuff and ankle pads included.

The invention will now be described in conjunction with the drawings, beginning with FIGS. 1, 2 and 3 which show a ski boot 20 of the type adapted for use with an inner shoe 22 such as described in the aforementioned U.S. Pat. No. 4,879,822. Although the invention is particularly adapted for use with rear entry ski boots which accommodate an inner shoe, the invention may also be practiced with conventional ski boots which do not require the use of an inner shoe.

Ski boot 20 includes a footbed 24 to which is pivotally mounted a front tongue member 26 and a rear ankle member 28. Although ankle member 28 is shown as a separate pivotable member, it may be formed as a fixed extension of the footbed 24 as shown in U.S. Pat. No. 4,879,822. For the reasons discussed below, only a single connector or binding such as the single strap 30 and single buckle 32 is required to secure the tongue and ankle members together during use.

A padded front cuff 34 may be mounted to the upper inner surface of the front tongue member 26 to cushion the skier's lower shin region and a padded rear cuff 36 may be mounted to the upper inner surface of the rear ankle member 28 to cushion the skier's lower calf region. Upon closing the front tongue member and rear ankle member around a skier's foot, a secure and comfortable supportive force is evenly distributed by the front and rear cuffs.

Only a single binding 30,32 is required, due to the supplemental rigidity provided by the interconnections between the footbed, front tongue member and rear ankle member. Because of these interconnections, numerous bindings are not required. Thus, a particularly comfortable fit is provided around the skier's foot.

The above-noted interconnections are a particularly important aspect of the invention, one example of which is shown in detail in FIGS. 2 through 8. As seen in phantom in FIG. 2, when the front tongue member 26 and the rear ankle member 28 are secured together by the binding strap and buckle 30,32, the lower edge portions 38 of the front tongue member overlap and interengage the upper longitudinal edge portions 40 of the footbed 24. At the same time, the rear vertical or upper edge portions 42 of the front tongue member 26 overlap and interengage the vertical or front edge portions 44 of the rear ankle member 28.

Figure 6:
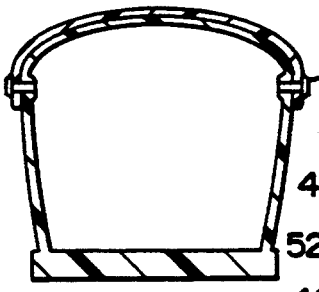
FIG. 6 is a view in section taken on line 6—6 of FIG. 5.
Figure 7:
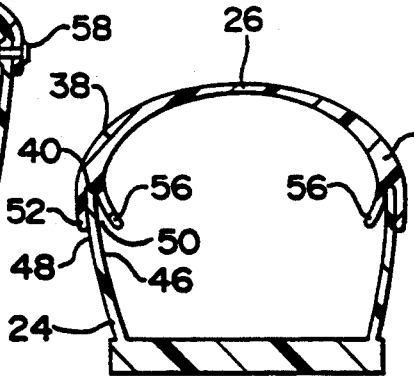
FIG. 7 is a view in section taken on line 7—7 of FIG. 5.
Figure 8:
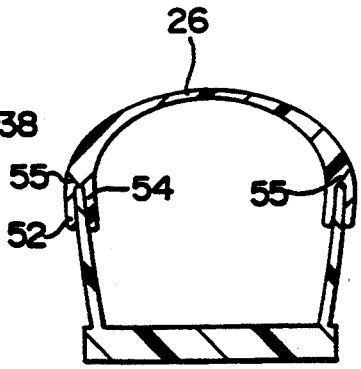
FIG. 8 is a view in section taken on line 8—8 of FIG. 5.

As best seen in FIGS. 5, 7 and 8, the lower edges 38 of the front tongue member 26 overlap both the inner surface 46 and outer surface 48 of the upper longitudinal edges 40 of the footbed 24 with a tongue and groove type interconnection. Although a simple tongue and groove interfit is shown in FIGS. 1 through 8, the lower edges 38 of the front tongue member 26 may be formed with pockets, holes, grooves, channels or recesses for receiving correspondingly shaped projections extending along the upper longitudinal edges 40 of the footbed 24. Alternatively, the positions of the recesses and projections on the footbed and front tongue member may be reversed.

It can be seen in FIGS. 7 and 8 that the groove or channel 50 which runs along and within the lower edge 38 of the front tongue member 28 is defined by an outer lip or outer wall 52 and an inner lip or inner wall 54. The front end portions 56 of the inner wall 54 may be flared inwardly to entrap and guide the upper edges 40 of the footbed 24 within groove 50 as the front tongue member is initially closed from its open position as shown in FIG. 3 to its closed position shown in FIG. 2.

The front tongue member may be injection molded as a homogeneous one-piece plastic member having the inner and outer walls 52,54 formed during molding. Alternatively, either the inner or outer wall may be fabricated as a separate component and connected to the front tongue member by a separate fastening operation. For example, the outer wall 52 may be separately molded from plastic and bonded to the plastic front tongue member 26 with adhesives or by ultrasonic welding such as along bond line 55 shown in FIG. 8.

It is also possible to practice the invention without outer wall 52, although rigidity would be somewhat reduced. For example, the outer wall 52 of the front cuff member as shown in FIGS. 7 and 8 could be eliminated so that the inner wall merely slides within the footbed pocket defined between inner footbed surfaces 46.

Figure 3:
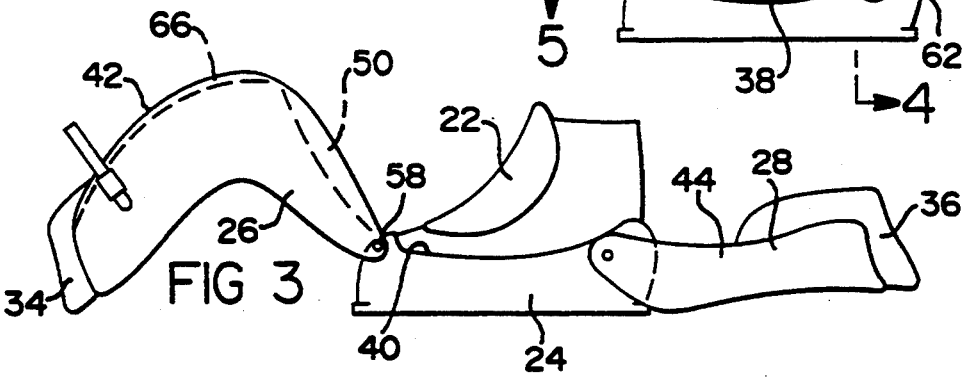
FIG. 3 is a view of FIG. 2, with the front tongue and rear ankle members pivoted to their open positions.
Figure 4:
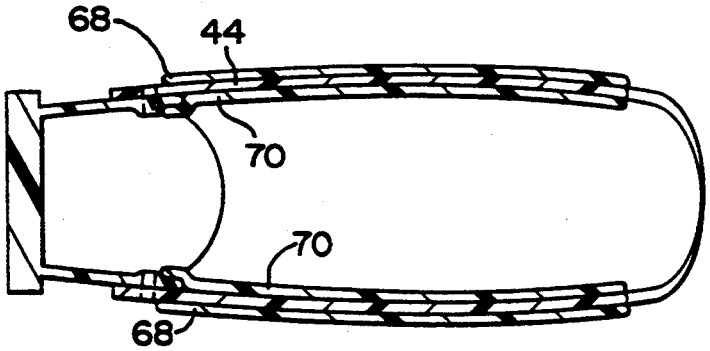
FIG. 4 is a view in section taken on line 4—4 of FIG. 2 with the cuff and ankle pads removed for clarity.

As seen in FIGS. 3, 5 and 6, the front tongue member is pivotally mounted to the front of the footbed 24 by a pair of bolts or rivets 58. The rear ankle member 28 is likewise pivotally mounted to the rear of the footbed 24 with a similar pair of bolts or rivets 60. A second set of tongue and groove inter-connections, discussed below in detail, is provided between the front tongue member 26 and the rear ankle member 28.

As shown in FIG. 5, in order to provide for a smooth continuous alignment, overlap and tongue and groove interengagement between the front edge portions 44 of the rear ankle member 28 and the rear edge portions 42 of the front tongue member 26, the rear sidewall portions 62 of the footbed 24 are transversely recessed or inwardly stepped at 64. In this manner, the rear ankle member 28 may form an attractive continuous flush fit with the outer surface of footbed 24 while achieving correct alignment with a channel or groove 66 (FIG. 3) formed along and within the upper edge portions 42 of the front tongue member 26.

As with the above-noted interconnections between the front tongue member and the footbed, the shape and location of the tongue and grooves or projections and pockets or recesses may be likewise varied between the front tongue member 26 and the rear ankle member 28. For the embodiment of FIGS. 1 through 8, groove 66 is defined by an outer wall 68 and an inner wall 70 each of which may be formed in a fashion such as that described above in connection with groove 50. As the front tongue member pivots rearwardly and engages the rear ankle member during boot closing, the front edge portions 44 of the rear ankle member 28 are guided into groove 66 by the cooperative alignment provided to the forwardly pivoting rear ankle member 28 by recessed rear side walls 62 of footbed 24 and to the front tongue member via the interengagement between grooves 50 of the front tongue member and the upper edges 40 of the footbed.

Once the boot is closed about a skier's foot, the strap and buckle are engaged in a conventional fashion to secure the front tongue member to the footbed and to the rear ankle member. The tongue and groove interconnections provide greater rigidity not only to the front tongue member for resisting transverse flexure and sideward flattening as the skier leans forward, but also provide greater rigidity to the footbed and rear ankle member. This is a definite benefit for high performance skiing where high boot rigidity provides greater skiing control and quicker response between the skier's foot and the ski.

A variation of the embodiment of FIGS. 1 through 8 is shown in FIGS. 9 and 10 wherein the locations of the tongue and grooves are switched. In this example, the footbed 24 is formed with grooved upper edges 72 for receiving the lower edges 38 of the front tongue member 26. Similar grooved edges 74 are formed along the front edge portions 44 of the rear ankle member 28 for receiving the upper or rear edge portions 42 of the front tongue member 26.

As noted above, the continuous channels or grooves and the continuous mating edge sections which form the tongue and groove connections in FIGS. 1 through 10 may be replaced with discrete projections and recesses or slots for increasing the assembled rigidity of the interengaged front tongue member, footbed and rear ankle member. Examples are shown in FIGS. 11, 12 and 13 wherein discrete inner tabs 76 are provided along the inner surfaces of the lower edge 38 and upper edge 42 of the front tongue member 26. Tabs 76 may be homogeneously molded with the front tongue member or subsequently attached by bonding or the like.

The tabs 76 located along the lower edge of the front tongue member 26 slide over the inner surface 46 of the footbed 24 in a manner similar to that of the inner wall 54 of groove 50 of FIGS. 7 and 8. The lower edge 38 of the front tongue member 26 overlaps the outer surface 48 of the footbed 24 in a manner similar to that of the outer wall 52 of groove 50 of FIGS. 7 and 8. A similar coaction and interfit is provided by the tab 76 which slides along the inner surface of the rear ankle member 28 and by the upper edge portions 42 of the front tongue member 26 which slide over the outer surface of the front edge portions 44 of the rear ankle member 26.

In FIGS. 11 and 12, the front tongue member 26 is pivotally mounted to the solid front portion or nose 78 of the footbed 24 by an axle 80 which extends completely across and through the nose 78 as seen in FIG. 13. By increasing the mass of the front portion of the footbed, the rigidity and strength of the front portion of the footbed is significantly increased so as rigidly secure and maintain the upper edges 42 of the footbed in position for proper engagement with the front tongue member. With the use of a solid massive footbed nose 78, added support is provided to the front tongue member when the boot is in use.

To add even further support and rigidity to the embodiment of FIGS. 11 and 12, one or more exterior tabs 82 may be provided on footbed 24 and rear ankle member 28. Exterior tabs 82 prevent the lower edges 38 and upper edges 42 of the front tongue member from flaring outwardly during forward flexing of a skier's foot and ankle. The location of the inner and outer tabs may be staggered as shown in FIG. 12 or aligned transversely side by side or in any other suitable pattern.

Obviously, numerous modifications and variations of the present invention are possible in the light of the above teachings. It is therefore to be understood that within the scope of the appended claims, the invention may be practiced otherwise than as specifically described herein.

What is claimed is:

1. A ski boot, comprising:

a footbed comprising an edge portion having a width bounded on opposite sides by an inner surface and an outer surface, said inner and outer surfaces defining a portion of a footbed sidewall;

a front tongue member movably connected to said footbed and comprising a tongue member edge portion releasably engagable with said footbed edge portion;

a pair of lips projecting outwardly from said tongue member for providing a rigid mutually-reinforcing interengagement between said footbed and said tongue member, said lips being spaced apart greater than the width of said footbed edge portion and said tongue member edge portion so as to overlap said inner and outer surfaces of said sidewall such that said interengagement comprises a rigidity greater than the rigidity of either one of said footbed edge portion and said tongue edge portion; and a rear ankle member extending from said footbed, said rear ankle member comprising a front edge portion defining inner and outer surface portions, said front tongue member further comprising an upper tongue edge portion and a wall portion extending from said upper tongue edge portion, and alignment means defined between said front edge portion of said rear ankle member and said upper tongue edge portion, said alignment means directing said wall portion of said upper tongue edge portion over said outer surface portion of said front edge portion of said rear ankle member.

2. The ski boot of claim 1, wherein said rigid interengagement comprises a channel formed in said edge portion of said front tongue member.

3. The ski boot of claim 1, wherein said rigid interengagement comprises tab means.

4. The ski boot of claim 1, wherein said footbed comprises a rigid front nose portion and wherein said front tongue member is pivotally connected to said footbed at said front nose portion.

5. The ski boot of claim 1, wherein said lips define a groove therebetween.

6. The ski boot of claim 5, wherein said interengagement is defined between said footbed edge portion and said groove.

7. A ski boot, comprising:

a footbed comprising an edge portion having a width bounded on opposite sides by an inner surface and an outer surface, said inner and outer surfaces defining a portion of a footbed sidewall;

a front tongue member movably connected to said footbed and comprising a tongue member edge portion releasably engagable with said footbed edge portion, said tongue member edge portion having a width bounded on opposite sides by inner and outer surfaces defining a portion of a tongue wall;

a pair of lips projecting outwardly from said footbed edge portion for providing a rigid mutually-reinforcing interengagement between said footbed and said tongue member, said lips being spaced apart greater than the width of said footbed edge portion and said tongue member edge portion so as to overlap said inner and outer surfaces of said tongue wall such that said interengagement comprises a rigidity greater than the rigidity of either one of said footbed edge portion and said tongue member edge portion; and a rear ankle member extending from said footbed, said rear ankle member comprising a front edge portion defining inner and outer surface portions, said front tongue member further comprising an upper tongue edge portion and a wall portion extending from said upper tongue edge portion, and alignment means defined between said front edge portion of said rear ankle member and said upper tongue edge portion, said alignment means directing said wall portion of said upper tongue edge portion over said outer surface portion of said front edge portion of said rear ankle member.

* * * * *